US005909496A

United States Patent [19]

Kishigami et al.

[11] Patent Number: 5,909,496

[45] Date of Patent: Jun. 1, 1999

[54] SPEAKER APPARATUS

[75] Inventors: Jun Kishigami, Saitama; Masao Fujihira, Kanagawa; Takahiro Muraguchi, Tokyo, all of Japan

[73] Assignee: Sony Corporation, Tokyo, Japan

[21] Appl. No.: 08/957,935

[22] Filed: Oct. 27, 1997

[30] Foreign Application Priority Data

Nov. 7, 1996 [JP] Japan ..... 8-311269

[51] Int. Cl.[6] ..... H04R 3/00

[52] U.S. Cl. ..... 381/111; 381/117; 381/401

[58] Field of Search ..... 381/111, 116, 381/117, 120, 123, 190, 400–402, 406, 408, FOR 155

[56] References Cited

U.S. PATENT DOCUMENTS

| | | | |
|---|---|---|---|
| 4,379,209 | 4/1983 | Sakano | 381/120 |
| 4,481,660 | 11/1984 | de Koning et al. | 381/120 |
| 4,555,797 | 11/1985 | Nieuwendijk et al. | 381/401 |
| 4,566,120 | 1/1986 | Nieuwendijk et al. | 381/117 |
| 4,612,420 | 9/1986 | Nieuwendijk et al. | 381/117 |
| 4,773,096 | 9/1988 | Kirn | 381/120 |
| 5,157,730 | 10/1992 | Liu | 381/111 |
| 5,347,587 | 9/1994 | Takahashi et al. | 381/111 |
| 5,592,559 | 1/1997 | Takahashi et al. | 381/111 |

FOREIGN PATENT DOCUMENTS

| | | | |
|---|---|---|---|
| 57-186898 | 11/1982 | Japan | 381/117 |
| 58-31699 | 2/1983 | Japan | 381/FOR 155 |
| 4-326291 | 11/1992 | Japan | 381/FOR 155 |
| 4-355599 | 12/1992 | Japan | 381/FOR 155 |

*Primary Examiner*—Curtis A. Kuntz
*Assistant Examiner*—Xu Mei
*Attorney, Agent, or Firm*—Jay H. Maioli

[57] ABSTRACT

A speaker apparatus which drives an electromagnetic-coupling-type speaker in accordance with a digital signal is provided with a speaker unit, and a plurality of amplifiers corresponding to the number of quantization bits of a digital audio signal. The output terminals of the amplifiers are connected to the respective primary coils, respectively, and the output impedances of the plurality of the amplifiers are made equal to those of the respective primary coils to which the amplifiers are connected. Each bit of each sample of the digital audio signal is amplified by the plurality of the amplifiers and supplied to the respective primary coils, respectively.

2 Claims, 6 Drawing Sheets

FIG. 5

| CURRENT | MSB | 2SB | 3SB | 4SB | 5SB | 6SB | 7SB | 8SB | 9SB | 10SB | 11SB | 12SB | 13SB | 14SB | 15SB | LSB |
|---|---|---|---|---|---|---|---|---|---|---|---|---|---|---|---|---|
| + | 0 | 1 | 1 | 1 | 1 | 1 | 1 | 1 | 1 | 1 | 1 | 1 | 1 | 1 | 1 | 1 |
| | 0 | 1 | 1 | 1 | 1 | 1 | 1 | 1 | 1 | 1 | 1 | 1 | 1 | 1 | 1 | 0 |
| | 0 | 1 | 1 | 1 | 1 | 1 | 1 | 1 | 1 | 1 | 1 | 1 | 1 | 1 | 0 | 1 |
| | 0 | 1 | 1 | 1 | 1 | 1 | 1 | 1 | 1 | 1 | 1 | 1 | 1 | 1 | 0 | 0 |
| | ⋮ | | | | | | | | ⋮ | | | | | | | |
| | 0 | 0 | 0 | 0 | 0 | 0 | 0 | 0 | 0 | 0 | 0 | 0 | 0 | 0 | 1 | 1 |
| | 0 | 0 | 0 | 0 | 0 | 0 | 0 | 0 | 0 | 0 | 0 | 0 | 0 | 0 | 1 | 0 |
| | 0 | 0 | 0 | 0 | 0 | 0 | 0 | 0 | 0 | 0 | 0 | 0 | 0 | 0 | 0 | 1 |
| 0 | 0 | 0 | 0 | 0 | 0 | 0 | 0 | 0 | 0 | 0 | 0 | 0 | 0 | 0 | 0 | 0 |
| | 1 | 0 | 0 | 0 | 0 | 0 | 0 | 0 | 0 | 0 | 0 | 0 | 0 | 0 | 0 | 1 |
| | 1 | 0 | 0 | 0 | 0 | 0 | 0 | 0 | 0 | 0 | 0 | 0 | 0 | 0 | 1 | 0 |
| | 1 | 0 | 0 | 0 | 0 | 0 | 0 | 0 | 0 | 0 | 0 | 0 | 0 | 0 | 1 | 1 |
| | ⋮ | | | | | | | | ⋮ | | | | | | | |
| | 1 | 1 | 1 | 1 | 1 | 1 | 1 | 1 | 1 | 1 | 1 | 1 | 1 | 1 | 0 | 0 |
| | 1 | 1 | 1 | 1 | 1 | 1 | 1 | 1 | 1 | 1 | 1 | 1 | 1 | 1 | 0 | 1 |
| | 1 | 1 | 1 | 1 | 1 | 1 | 1 | 1 | 1 | 1 | 1 | 1 | 1 | 1 | 1 | 0 |
| − | 1 | 1 | 1 | 1 | 1 | 1 | 1 | 1 | 1 | 1 | 1 | 1 | 1 | 1 | 1 | 1) |

| COIL | 1P | 1N | 1M | 1L | 1K | 1J | 1I | 1H | 1G | 1F | 1E | 1D | 1C | 1B | 1A |
|---|---|---|---|---|---|---|---|---|---|---|---|---|---|---|---|

FIG. 6

| MSB | 2SB | 3SB | 4SB | 5SB | 6SB | 7SB | 8SB | 9SB | 10SB | 11SB | 12SB | 13SB | 14SB | 15SB | LSB |
|---|---|---|---|---|---|---|---|---|---|---|---|---|---|---|---|
| 0 | 1 | 1 | 1 | 1 | 1 | 1 | 1 | 1 | 1 | 1 | 1 | 1 | 1 | 1 | 1 |
| 0 | 1 | 1 | 1 | 1 | 1 | 1 | 1 | 1 | 1 | 1 | 1 | 1 | 1 | 1 | 0 |
| 0 | 1 | 1 | 1 | 1 | 1 | 1 | 1 | 1 | 1 | 1 | 1 | 1 | 1 | 0 | 1 |
| 0 | 1 | 1 | 1 | 1 | 1 | 1 | 1 | 1 | 1 | 1 | 1 | 1 | 1 | 0 | 0 |
| ⋮ | | | | | | | | ⋮ | | | | | | | |
| 0 | 0 | 0 | 0 | 0 | 0 | 0 | 0 | 0 | 0 | 0 | 0 | 0 | 0 | 1 | 1 |
| 0 | 0 | 0 | 0 | 0 | 0 | 0 | 0 | 0 | 0 | 0 | 0 | 0 | 0 | 1 | 0 |
| 0 | 0 | 0 | 0 | 0 | 0 | 0 | 0 | 0 | 0 | 0 | 0 | 0 | 0 | 0 | 1 |
| 0 | 0 | 0 | 0 | 0 | 0 | 0 | 0 | 0 | 0 | 0 | 0 | 0 | 0 | 0 | 0 |
| 1 | 0 | 0 | 0 | 0 | 0 | 0 | 0 | 0 | 0 | 0 | 0 | 0 | 0 | 0 | 1 |
| 1 | 0 | 0 | 0 | 0 | 0 | 0 | 0 | 0 | 0 | 0 | 0 | 0 | 0 | 1 | 0 |
| 1 | 0 | 0 | 0 | 0 | 0 | 0 | 0 | 0 | 0 | 0 | 0 | 0 | 0 | 1 | 1 |
| ⋮ | | | | | | | | ⋮ | | | | | | | |
| 1 | 1 | 1 | 1 | 1 | 1 | 1 | 1 | 1 | 1 | 1 | 1 | 1 | 1 | 0 | 0 |
| 1 | 1 | 1 | 1 | 1 | 1 | 1 | 1 | 1 | 1 | 1 | 1 | 1 | 1 | 0 | 1 |
| 1 | 1 | 1 | 1 | 1 | 1 | 1 | 1 | 1 | 1 | 1 | 1 | 1 | 1 | 1 | 0 |
| 1 | 1 | 1 | 1 | 1 | 1 | 1 | 1 | 1 | 1 | 1 | 1 | 1 | 1 | 1 | 1 |

SPEAKER APPARATUS

BACKGROUND OF THE INVENTION

1. Field of the Invention

The present invention relates to a speaker apparatus of a digital driving method.

2. Description of the Related Art

Speaker apparatuses are generally driven in accordance with an analog audio signal. Speaker apparatuses which can be driven directly in accordance with a digital audio signal have been conceived.

In FIG. 3, reference numeral 10 denotes an example of a speaker unit for use in such a speaker apparatus of a digital driving method. This speaker unit 10 is constructed into an electromagnetic coupling type. In this example, a cutout 13 is formed around the front end portions of a center pole section 12 of a yoke 11 formed of the center pole section 12 and a flange section 14, and a primary coil 1 which will be described later is mounted to this cutout 13.

In this case, the primary coil 1 is mounted in such a manner that it is wound as an air-core coil and bonded to the cutout 13, or it is directly wound around the cutout 13, or although not shown, it is wound around a bobbin made of a magnetic material and the bobbin is fitted into the cutout 13 and bonded thereto.

Further, in the flange section 14 of the yoke 11, a hole or opening 15 is formed in a part of a position proximate continuously to the center pole section 12, with a terminal plate 16 mounted on the rear surface of the flange section 14. Then, a lead wire 17 of the primary coil 1 is bonded onto the peripheral surface of the center pole section 12 and inserted into the opening 15, and is connected to a terminal 18 of the terminal plate 16 by soldering or the like.

Further, an annular permanent magnet 21 is bonded onto the front surface of the flange section 14, an annular plate 22 is bonded to the front surface of the permanent magnet 21, and thus a magnetic circuit 20 having a gap 23 between the outer peripheral surface of the front end portion of the center pole section 12 and the inner peripheral surface of the annular plate 22 is formed.

Further, a secondary coil 2 is disposed in the gap 23. In this example, this secondary coil 2 is formed as a cylindrical body made of a non-magnetic conducting material, for example, aluminum and formed into a short coil of one turn.

Further, the inner peripheral portion of a vibration plate, i.e., cone 32, a dust-tight cap 33, and the inner peripheral portion of a damper 34 are mounted to the secondary coil 2, and a speaker frame 35 is mounted to the plate 22. An edge 31 is mounted to the outer peripheral portion of the cone 32, the edge 31 and a gasket 36 are mounted to the speaker frame 35, and the outer peripheral portion of the damper 34 is mounted to the speaker frame 35.

If it is assumed that the digital audio signal is in a format used for CDs and DATs, that is, the number of quantization bits is 16 bits and in the form of two's complement, as shown in FIG. 5, the MSB thereof is a sign bit, which indicates the polarity of the analog audio signal when this digital audio signal is converted from digital to analog form, and 2SB to LSB of which indicate the level of the analog audio signal.

Thus, the above-described primary coil 1 is formed of, for example, 15 coils 1A to 1N, and 1P in correspondence with the digital audio signal, as shown in the lower part of FIG. 5. The number of windings of the coils 1A to 1P is made to be a value corresponding to the weight of each bit of the digital audio signal.

More specifically, as shown in, for example, FIG. 5, if the coils 1A to 1P correspond to the LSB to 2SB of the digital audio signal, the number of windings of a coil corresponding to a certain bit is made twice the number of windings of a coil corresponding to the bit of one lower order, for example, the number of windings of coil 1A is 2, the number of windings of coil 1B is 4, the number of windings of coil 1C is 8, and so on. That is, the ratio of the windings of the coils 1A to 1P is 20 to 214 (x**y indicates the y-th power of x in the geometrical series of common ratio 2. Hereinafter the same applies).

FIG. 4 shows an example of a signal system of the speaker apparatus of a digital driving method. Reference numerals 44A to 44N, and 44P denote constant-current circuits. These constant-current circuits 44A to 44P are connected to positive and negative power lines and operate in a forward-type mode or reverse-type mode in accordance with a control signal from an external source. In the forward-type mode, a DC current (constant current) I of a predetermined fixed magnitude flows to a load, and in the reverse-type mode, a DC current I of the same magnitude as that in the forward-type mode flows from the load.

Bidirectional switching circuits 45A to 45N, and 45P, and the coils 1A to 1N, and 1P of the speaker unit 10 are connected in series between the output terminals of the constant-current circuits 44A to 44N, and 44P and a ground, respectively.

Further, a digital audio signal SD reproduced from, for example, a CD is supplied to a shift register 42 with serial input and parallel output through an input terminal 41. The signal SD is converted into parallel data for each sampling, the MSB of the converted signal SD is supplied as a switching signal between the forward-type mode and the reverse-type mode to the constant-current circuits 44A to 44P, controlling the constant-current circuits 44A to 44P so as to operate in the forward-type mode when MSB="0" and to operate in the reverse-type mode when MSB="1".

Further, the LSB to 2SB of the signal SD from the register 42 is supplied to a decoder circuit 43 and the MSB is supplied to the decoder circuit 43. Thus, the LSB to 2SB of the signal SD are converted or decoded into the form of lower-order 15 bits in a reflected binary code, namely, binary data indicating the absolute value of the signal SD, as shown in FIG. 6.

Then, the LSB to 2SB after conversion are supplied to the switching circuits 45A to 45P as control signals; when the bit is "0", the corresponding switching circuit is turned off, and when the bit is "1", the corresponding switching circuit is turned on.

With such a construction, when current I flows through the primary coil 1 (1A to 1P), since the primary coil 1 and the secondary coil 2 are electromagnetically coupled to each other, an electric current is induced in the secondary coil 2, and this current flows through the secondary coil 2. Therefore, similarly to a conventional speaker, the cone 32 deviates in a forward or backward direction in correspondence with the polarity of the electric current which flows through the primary coil 1.

When the MSB of the digital audio signal SD is "0", the constant-current circuits 44A to 44P are set to a forward-type mode operation. Therefore, the constant currents I to I flow through components in the following order: the constant-current circuits 44A to 44P, the switching circuits 45A to 45P, the primary coils 1A to 1P, and the ground. When the MSB of the signal SD is "1", the constant-current circuits 44A to 44P is set to the reverse-type mode operation.

Therefore, the constant currents I to I flow through components in the following order: the ground, the primary coils 1A to 1P, the switching circuits 45A to 45P, and the constant-current circuits 44A to 44P.

That is, the polarity of the constant currents I to I which flow through the coils 1A to 1P reverses according to the value of the MSB. Therefore, the deviation direction of the cone 32 of the speaker unit 10 is controlled by the MSB of the signal SD.

Further, the LSB to 2SB of the signal SD output from the decoder circuit 43 indicate the absolute value of the analog audio signal when the signal is converted from the signal SD from digital to analog form. When a certain bit of the LSB to 2SB is "1", the corresponding switching circuit of the switching circuits 45A to 45P is turned on, causing a constant current I to flow through a corresponding primary coil of the primary coils 1A to 1P.

At this time, since, for example, the number of windings of the coil 1B is made twice the number of windings of the coil 1A, the magnitude of the electric current which flows through the secondary coil 2 when the current I flows through the coil 1B becomes twice the electric current which flows through the secondary coil 2 when the current I flows through the coil 1A. The same applies for the other adjacent coils.

That is, even if the magnitude of the constant currents I to I which flow through the coils 1A to 1P is equal, since the ratio of the number of windings is set as described above, the magnitude of the electric current which flows through the secondary coil 2 differs in correspondence with the ratio of the number of windings. The ratio of the number of windings of the coils 1A to 1P is a value corresponding to the weight of each bit of the digital audio signal SD. Therefore, when the cone of the speaker unit 10 deviates, the amount of the deviation corresponds to the absolute value indicated by the LSB to 2SB.

As a result of the above, the cone 32 of the speaker unit 10 deviates in a direction and by an amount corresponding to the MSB and the LSB to 2SB of the digital audio signal SD for each sampling. Therefore, a reproduction sound of the digital audio signal SD is output from the speaker unit 10.

In this case, the digital audio signal has been digitized at a sampling frequency of 44.1 kHz or 48 kHz. Since the coils 1A to 1P are driven in accordance with the digital signal, the low-frequency components of the analog audio signal before being digitized become a high frequency over 20 kHz as a signal current flowing through each of the coils 1A to 1P of the primary coil 1. Therefore, the speaker unit 10 is able to reproduce low-frequency components.

Similarly to a conventional speaker, the vibration system of the speaker unit 10 has difficulty responding to high frequencies and can hardly reproduce high-frequency components, in particular, components over 20 kHz. Therefore, even if the primary coils 1A to 1P are driven in accordance with the digital audio signal of a sampling frequency of 44.1 kHz or 48 kHz, the components of the sampling frequency are hardly reproduced. If the components were reproduced, since they are reproduced with very small sound pressure and sound with a frequency over 20 kHz can hardly be heard by the human ear, no inconvenience occurs.

Thus, according to this speaker apparatus, it is possible to convert a digital audio signal into a reproduction sound without performing D/A conversion.

However, in the above-described speaker apparatus of a digital driving method, the constant-current circuits 44A to 44P must operate in the forward-type mode or the reverse-type mode according to the MSB of the signal SD. Such constant-current circuits become complex in construction, resulting in a high cost.

Further, when the output of the speaker apparatus is increased, the current I which flows through the coils 1A to 1P must be increased; therefore, the construction becomes more complex and expensive. Moreover, as many as 15 such constant-current circuits are required as indicated by the reference numerals 44A to 44P in FIG. 4.

Furthermore, since the constant currents I to I to be supplied to the coils 1A to 1P are turned on and off respectively according to "0" and "1" of the LSB to 2SB of each sample of the digital audio signal SD, the highest frequency thereof becomes the sampling frequency of 44.1 kHz or 48 kHz of the signal SD. For this reason, the impedance when the coils 1A to 1P are seen from the constant currents I to I becomes several kΩ, and the switching circuits 45A to 45P must supply the constant currents I to I to the coils 1A to 1P having such a large impedance. Likewise, the construction becomes complex and expensive.

SUMMARY OF THE INVENTION

It is an object of the present invention to solve the above-described problems.

To achieve the above-described object, according to the present invention, there is provided a speaker apparatus, comprising: a speaker unit; and a plurality of n amplifiers corresponding to the number of quantization bits of a digital audio signal, wherein the speaker unit is formed into an electromagnetic-coupling-type speaker such that a gap is formed in a magnetic circuit, n primary coils are fixed to a portion proximate to the gap, a secondary coil is disposed within the gap in such a manner as to be fixed to a cone, an electric current is induced in the secondary coil by an electric current which flows through the n primary coils, causing the cone to vibrate, the output terminals of the n amplifiers are connected to the n primary coils, respectively, the output impedances of the n amplifiers are equal to the impedances of the primary coils to which the amplifiers are connected, and each bit of each sample of the digital audio signal is amplified by the amplifiers and supplied to the primary coils, respectively.

Therefore, a reproduction sound of an analog audio signal which is converted from a digital audio signal to analog form is output from a speaker.

The above and further objects, aspects and novel features of the invention will become more apparent from the following detailed description when read in connection with the accompanying drawings.

BRIEF DESCRIPTION OF THE DRAWINGS

FIG. 5 shows the present invention; and

FIG. 6 shows the present invention.

DESCRIPTION OF THE PREFERRED EMBODIMENT

Figure 1:
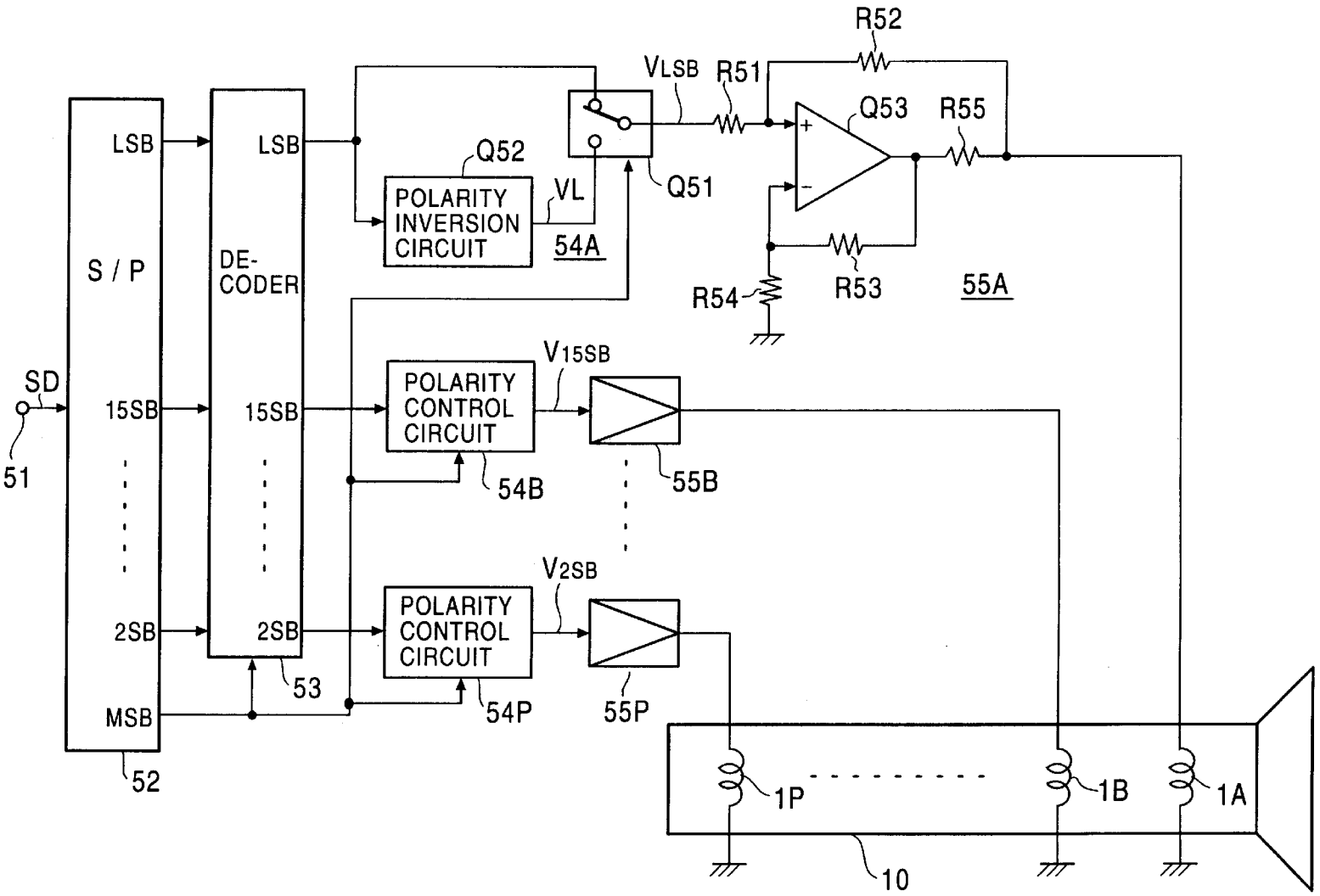
FIG. 1 is a connection diagram illustrating an embodiment of the present invention.

In FIG. 1, a case is shown in which an input digital audio signal SD is reproduced from, for example, a CD, and one sample is a 16-bit serial signal and in the form of two's complement.

Figure 3:
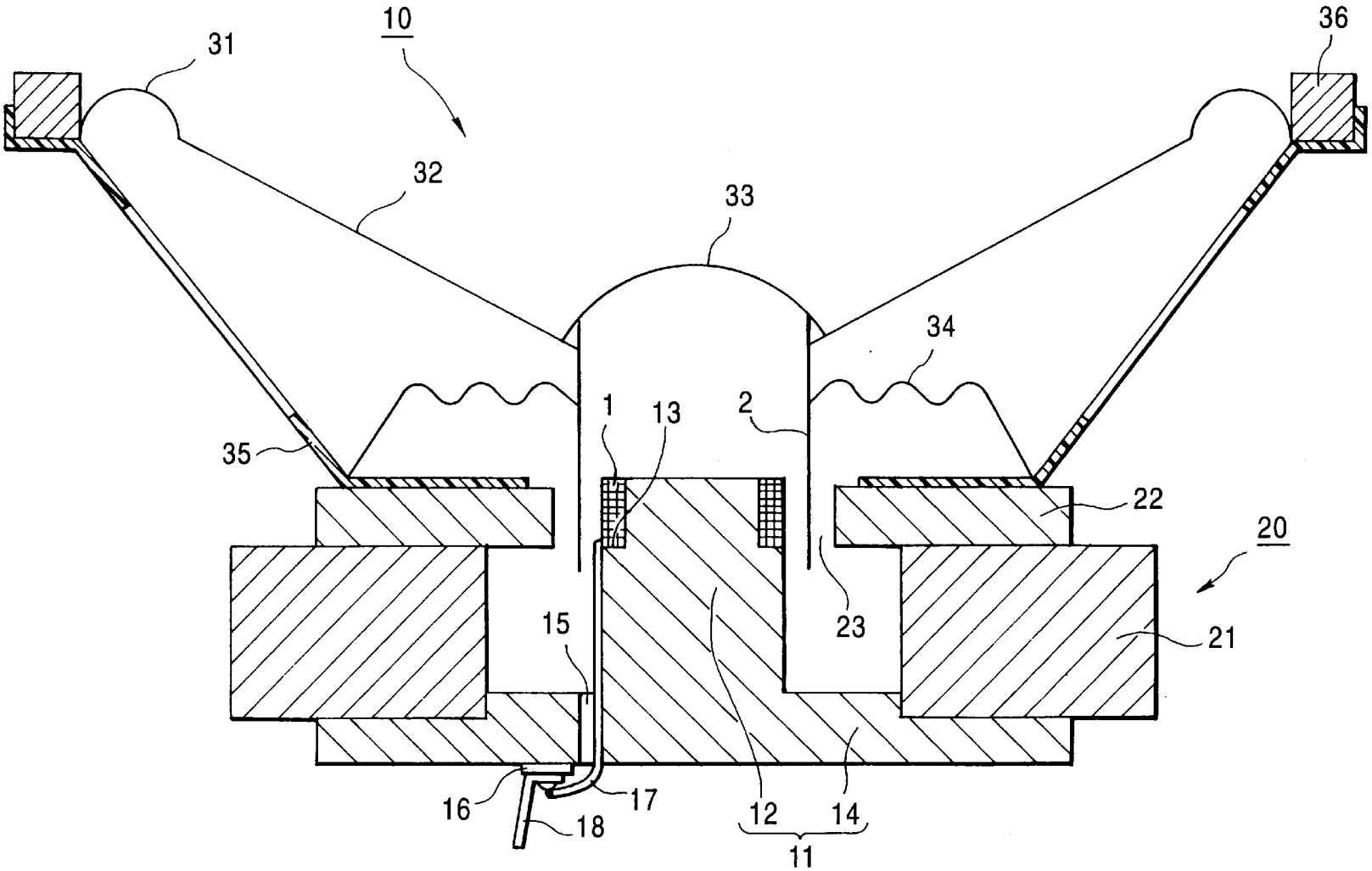
FIG. 3 is a sectional view illustrating the present invention.

In FIG. 1, a speaker unit 10 is constructed into an electromagnetic coupling type as described in FIG. 3. A primary coil 1 is formed of 15 primary coils 1A to 1N, and 1P in correspondence with the number of bits of the digital audio signal SD. In this case, the ratio of the windings of the coils 1A to 1P is 20 to 214 in the geometrical series of common ratio 2.

Further, the digital audio signal SD is supplied to a serial/parallel conversion circuit, for example, a shift register 52 with serial input and parallel output, through an input terminal 51, whereby the signal SD is converted into parallel data in units of one sample. Further, the LSB to 2SB of this converted signal SD is supplied to a decoder circuit 53 and the MSB is supplied to the decoder circuit 53, and the LSB to 2SB of the signal SD are converted or decoded into a form of lower-order 15 bits in a reflected binary code, namely, binary data indicating the absolute value of the signal SD, as shown in FIG. 6.

Then, the LSB to 2SB after conversion are supplied to the polarity switching circuits 54A to 54P. In this case, since polarity switching circuits 54A to 54P have an identical construction, a description will be given using the polarity switching circuit 54A as a typical example. As shown in, for example, FIG. 2A, the LSB of positive logic is output from the decoder 53, this LSB is supplied to a switching circuit Q51 and also to a polarity inversion circuit Q52, forming it into a voltage VL whose polarity is inverted as shown in FIG. 2B, and this voltage VL is supplied to the switching circuit Q51.

Further, the MSB from the shift register 52 is supplied to the input terminal 51 as a control signal. The switching circuit Q51 is set in the state shown in the figure when MSB="0", and when MSB="1", the switching circuit Q51 is set in the state opposite to that shown in the figure. Therefore, a signal (voltage) VLSB which becomes LSB when MSB="0" and becomes voltage VL when MSB="1" is output from the switching circuit Q51, as shown in FIGS. 2C and 2D. Further, signals V15SB to V2SB which are formed to be bipolar from the bits 15SB to 2SB are also output from the polarity control circuits 54B to 54P in the same manner as the signal VLSB.

Figure 2:
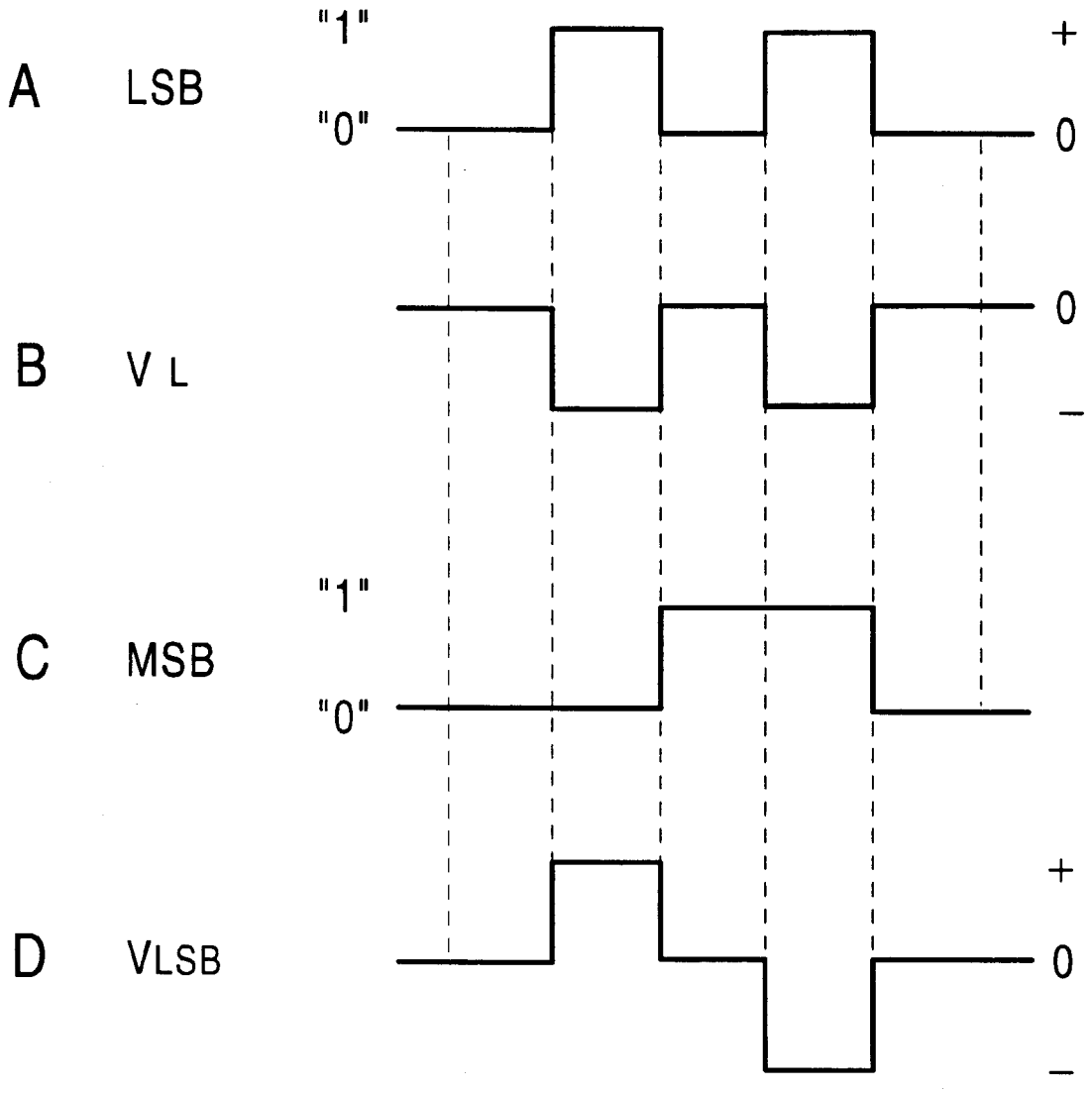
FIG. 2 is a wave chart illustrating the present invention.

In this case, the signals VLSB to V2SB are signals such that the original digital audio signal SD has been converted into a reflected binary code and when MSB="1", that is, when the sign bit indicates a negative polarity, the logic "1" portions of the reflected binary code are converted into a negative voltage, as shown in FIG. 2D; therefore, when weights corresponding to the LSB to 2SB are added to the signals VLSB and V2SB and added together, the result is a signal such that the digital audio signal SD is converted from digital to analog form.

Thus, these signals VLSB to V2SB are power-amplified by output amplifiers 55A to 55P and supplied to the coils 1A to 1P. In this case, the output amplifiers 55A to 55P are formed into feedback amplifiers, as shown in, for example, FIG. 1.

More specifically, in the amplifier 55A, an amplifier Q53 which uses positive and negative voltages as operation powers is provided. The output terminal of the switching circuit Q51 is connected to the non-inversion input terminal of the amplifier Q53 through a resistor R51, the output terminal of the amplifier Q53 is connected to the coil 1A of the speaker unit 10 through a resistor R55, and the connection point of the resistor R55 and the coil 1A is connected to the non-inversion input terminal through a resistor R52.

Further, the output terminal of the amplifier Q53 is connected to the non-inversion input terminal of the amplifier Q53 through the resistor R53, and a resistor R54 is connected between this non-inversion input terminal and ground. At this time, by setting the values of the resistors R51 to R54 as will be described later, the output impedance of the amplifier 55A becomes equal to the impedance of the coil 1A. Furthermore, the output amplifiers 55B to 55P and the coils 1B to 1P are constructed in the same way as the amplifier 55A and the coil 1A.

With such a construction, since the signals VLSB to V2SB are power-amplified by the amplifiers 55A to 55P and supplied to the coils 1A to 1P, and the coils 1A to 1P have a number of windings corresponding to the weighted values of LSB to 2SB, a reproduction sound of the digital audio signal SD is output from the speaker unit 10.

In this case, since positive feedback is applied to the respective amplifiers Q53 and Q53 of the 16 output amplifiers 55A to 55P by the respective resistors R52 and R52 and negative feedback is applied by the respective resistors R53 and R53, by setting the amount of feedback, it is possible to make the output impedances of the output amplifiers 55A to 55P equal to the impedances of the coils 1A to 1P, respectively.

That is, for example, in the amplifier 55A, if the impedance of the coil 1A is denoted as ZL, the signal voltage of the voltage VLSB is denoted as Vi, the signal voltage supplied to the coil 1A is denoted as Vo, the signal voltage supplied to the non-inversion input terminal of the amplifier Q53 is denoted as V+, and the signal voltage supplied to the non-inversion input terminal of the amplifier Q53 is denoted as V−, the following relations are satisfied:

$$V+=(R52Vi+R51Vo)/(R51+R52)$$

$$V-=R54/(R53+R54)\cdot(1+R55/ZL)\cdot Vo$$

Thus, if V+=V−, the above equations produce $$(R52Vi+R51Vo)/(R51+R52)=R54/(R53+R54)\cdot(1+R55/ZL)\cdot Vo$$

A modification of this equation produces the following equation:

$$R52/(R51+R52)\cdot Vi+R51/(R51+R52)\cdot Vo=R54/(R53+R54)\cdot(1+R55/ZL)\cdot Vo$$

Then, in this equation, if the following equations are set $$\alpha=R51/(R51+R52) \quad (1)$$

$$\beta=R54/(R53+R54) \quad (2)$$

the above equation becomes:

$$R52/(R51+R52)\cdot Vi+\alpha Vo=\beta(1+R55/ZL)\cdot Vo$$

and further, $$(1-\alpha)Vi+\alpha Vo=\beta(1+R55/ZL)Vo$$

Then, modifying this equation produces the following:

$$\begin{aligned}(1-\alpha)Vi &= \beta(1+R55/ZL)Vo-\alpha Vo\\ &= (\beta(1+R55/ZL)-\alpha)Vo\\ &= (\beta-\alpha+\beta R55/ZL)Vo\end{aligned}$$

Therefore, $$Vo = \frac{1-\alpha}{\beta-\alpha} \cdot \frac{ZL}{\beta/(\beta-\alpha)\cdot R55 + ZL} Vi$$

Therefore, the output impedance Zo of the amplifier 55A becomes:

$$Zo=\beta/(\beta-\alpha)\cdot R55 \quad (3)$$

Therefore, if the values of the resistors R51 to R55 are set so as to satisfy equations (1) to (3), it is possible to make the output impedance Zo of the amplifier 55A equal to the impedance ZL of the coil 1A.

If, for example, R55=0.47Ω when ZL=100Ω, since Zo=ZL in equation (3), $$100=\beta/(\beta-\alpha)\times 0.47$$

and $$\alpha=0.9953\beta$$

Therefore, if the values of the resistors R51 to R54 are selected so as to satisfy this equation, it is possible to make the output impedance Zo of the amplifier 55A equal to the impedance ZL of the coil 1A.

For the other output amplifiers 55B to 55P, in a similar manner, the output impedance can be made equal to the impedance of the coils 1B to 1P.

Figure 4:
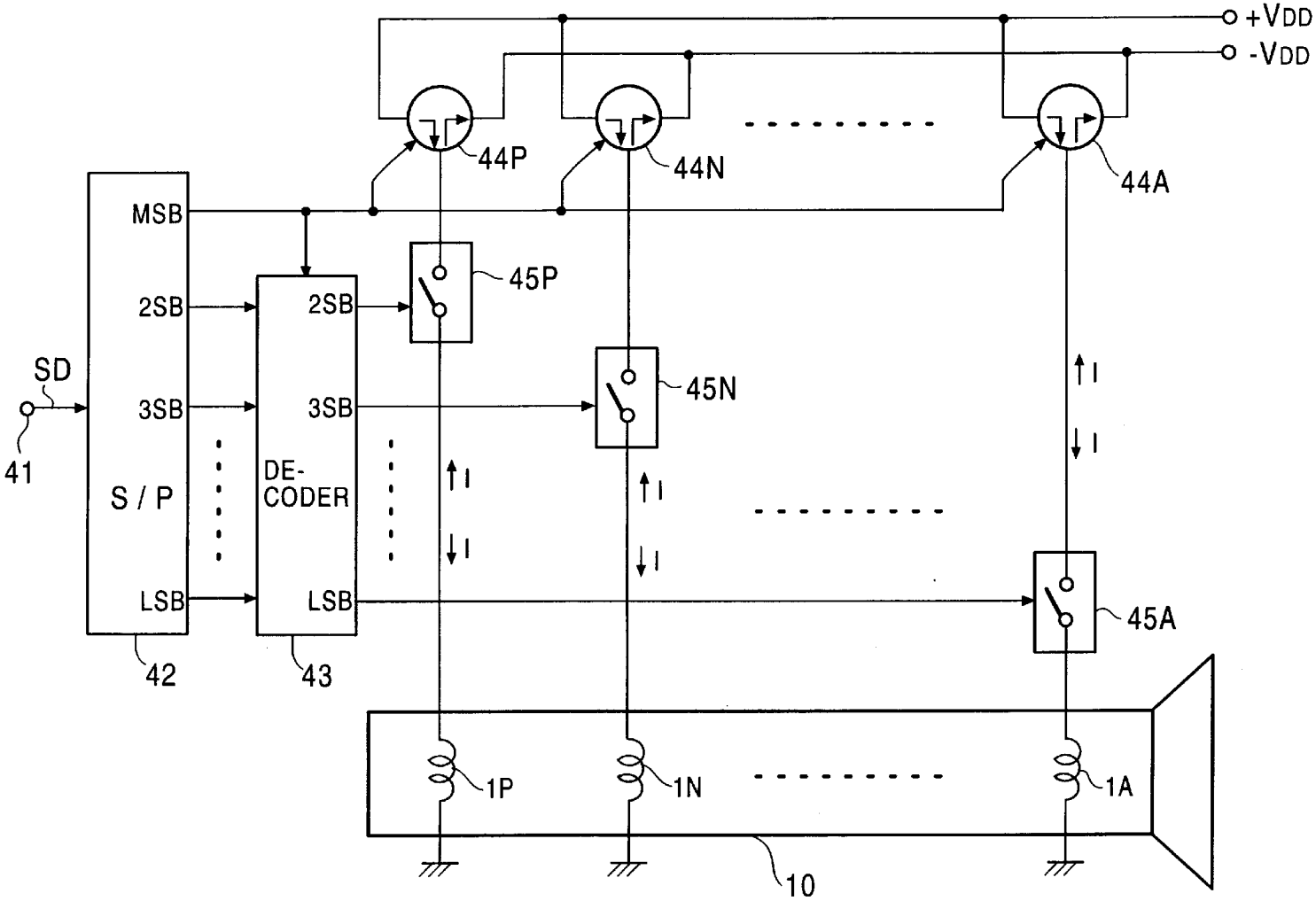
FIG. 4 is a connection diagram illustrating the present invention.

In the above-described way, according to this speaker apparatus, it is possible to convert the digital audio signal SD into a reproduction sound without performing D/A conversion. In this case, according to, in particular, the above-described speaker apparatus, since the coils 1A to 1P are driven by the output amplifiers 55A to 55P, the construction is simpler and the cost can be reduced to less than the case where the constant-current circuits 42A to 42P which operate in the forward-type mode or the reverse-type mode like the speaker apparatus of FIG. 4.

Further, when the coils 1A to 1P are driven by the amplifiers 55A to 55P, the output impedance of the output amplifiers 55A to 55P is made equal to the impedance of the coils 1A to 1P; therefore, when the signals VLSB to V2SB are supplied from the output amplifiers 55A to 55P to the coils 1A to 1P, the efficiency can be maximized.

Furthermore, when the output of the speaker apparatus is increased, the output amplifiers 55A to 55P having a large output may be prepared, which is simple.

In the above description, the ratio of the number of windings of the primary coils 1A to 1P is 20 to 214 in correspondence with the LSB to 2SB of the digital audio signal SD. However, the number of windings of the coils 1A to 1P may be made equal, and the ratio of the magnitudes of the output currents of the amplifiers 55A to 55P may be 20 to 214 in the geometrical series of common ratio 2.

Or, it is possible to combine the two cases, that is, the ratio of the product of the magnitude of the output currents of the amplifiers 55A to 55P and the number of windings of the primary coils 1A to 1P may correspond to the weights of LSB to 2SB of the digital audio signal SD.

Further, a part of the primary coil 1 (1A to 1P) may be mounted onto the inner peripheral surface of the annular plate 22, or all of the primary coil 1 may be mounted onto the inner peripheral surface of the annular plate 22.

According to the present invention, when an electromagnetic-coupling speaker is driven in accordance with a digital audio signal, the construction is simple, and the cost can be reduced. Further, when coils are driven, the efficiency can be maximized. Further, when the output of the speaker apparatus is increased, this can be performed easily.

Many different embodiments of the present invention may be constructed without departing from the spirit and scope of the present invention. It should be understood that the present invention is not limited to the specific embodiment described in this specification. To the contrary, the present invention is intended to cover various modifications and equivalent arrangements included within the spirit and scope of the invention as hereafter claimed. The scope of the following claims is to be accorded the broadest interpretation so as to encompass all such modifications, equivalent structures and functions.

What is claimed is:

1. A speaker apparatus, comprising:

a speaker unit; and a plurality of n amplifiers, where n is a whole number corresponding to a number of quantization bits of a digital audio signal, wherein said speaker unit is formed into an electromagnetic-coupling-type speaker such that a gap is formed in a magnetic circuit, n primary coils are fixed to a portion of said speaker unit proximate to said gap, a secondary coil is disposed within said gap and fixed to a cone, an electric current is induced in said secondary coil by an electric current which flows through said n primary coils, causing said cone to vibrate, a plurality of output terminals of said n amplifiers are connected to said n primary coils, respectively, output impedances of said n amplifiers are equal to impedances of said primary coils to which the amplifiers are connected, and each bit of each sample of said digital audio signal is amplified by said amplifiers and supplied to said primary coils, respectively.

2. A speaker apparatus according to claim 1, wherein when the number of quantization bits of said digital audio signal is (n+1) bits, said n primary coils have a number of windings corresponding to a weighted value of the second most significant bit (2SB) to the least significant bit (LSB) of said digital audio signal, each of the 2SB to LSB of each sample of said digital audio signal is converted into data which indicates an absolute value of the sample, each bit after the conversion is amplified by said n amplifiers and supplied to said primary coils, respectively, and polarities of the 2SB to LSB of said digital audio signal are controlled by the most significant bit of each sample of said digital audio signal.

* * * * *